US008567701B2

(12) United States Patent
Hashii et al.

(10) Patent No.: US 8,567,701 B2
(45) Date of Patent: Oct. 29, 2013

(54) FUEL INJECTION VALVE

(75) Inventors: Naoya Hashii, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 1021 days.

(21) Appl. No.: 12/609,855

(22) Filed: Oct. 30, 2009

(65) Prior Publication Data

US 2010/0288857 A1 Nov. 18, 2010

(30) Foreign Application Priority Data

May 18, 2009 (JP) ..... 2009-119977

(51) Int. Cl.

| | |
|---|---|
| ***B05B 1/34*** | (2006.01) |
| ***B05B 1/30*** | (2006.01) |
| ***F02M 51/00*** | (2006.01) |
| ***B05B 1/00*** | (2006.01) |
| ***A62C 31/02*** | (2006.01) |

(52) U.S. Cl.
USPC ..... 239/601; 239/490; 239/533.14; 239/584; 239/585.1; 239/585.4; 239/596

(58) Field of Classification Search
USPC ..... 239/490, 504, 533.11, 533.12, 533.14, 239/584, 585.1, 585.4, 596, 601, 900
See application file for complete search history.

(56) References Cited

U.S. PATENT DOCUMENTS

| | | | | |
|---|---|---|---|---|
| 5,785,254 | A | 7/1998 | Zimmermann et al. | |
| 6,050,507 | A * | 4/2000 | Holzgrefe et al. | 239/585.1 |
| 6,168,099 | B1 * | 1/2001 | Hopf et al. | 239/596 |
| 6,170,763 | B1 | 1/2001 | Fuchs et al. | |
| 6,669,116 | B2 * | 12/2003 | Iwase | 239/533.12 |
| 6,854,670 | B2 * | 2/2005 | Sumisha et al. | 239/543 |
| 2004/0144870 | A1 * | 7/2004 | Tani et al. | 239/585.1 |

FOREIGN PATENT DOCUMENTS

| | | | |
|---|---|---|---|
| JP | 7-259698 | A | 10/1995 |
| JP | 8-254170 | A | 10/1996 |
| JP | 10-506695 | A | 6/1998 |
| JP | 2000-508739 | A | 7/2000 |
| JP | 2001-303360 | A | 10/2001 |
| JP | 2003-336562 | A | 11/2003 |
| JP | 2003-336563 | A | 11/2003 |
| JP | 2005-207274 | A | 8/2005 |
| JP | 2006-002620 | A | 1/2006 |
| JP | 2006-336577 | A | 12/2006 |
| JP | 2007-182767 | A | 7/2007 |

* cited by examiner

*Primary Examiner* — Ryan Reis
(74) *Attorney, Agent, or Firm* — Sughrue Mion, PLLC

(57) ABSTRACT

A fuel injection valve for an internal combustion engine is provided. The fuel injection value includes an injection hole plate having a plurality of fuel chambers formed by recessing part of the upstream side of the injection hole plate at a plurality of positions along the valve seat opening portion Each of the fuel chambers has a shape in which the halves are symmetric with each other with respect to a line that radially extends from the center of the injection hole plate. The fuel chambers are is disposed in a place that ranges from the inside of a virtual circle to the outside of the inner circumference of the valve seat opening portion. Two injection holes are arranged outside the inner circumference of the valve seat opening portion in such a way as to flank the radial center line of the fuel chamber.

15 Claims, 14 Drawing Sheets

FUEL INJECTION VALVE

BACKGROUND OF THE INVENTION

1. Field of the Invention

The present invention relates to an electromagnetic fuel injection valve utilized mainly in the fuel supply system of an internal combustion engine.

2. Description of the Related Art

In recent years, while restrictions on exhaust gas from a vehicle and the like have been tightened, there has been required improvement in atomization of a fuel injected through a fuel injection valve, and hence various kinds of studies about atomization have been made. In the prior arts disclosed in Japanese Patent Application Laid-Open No. 2003-336562 and Japanese Patent Application Laid-Open No. 2003-336563, a fuel injection valve is configured in such a way that respective guide paths are provided for the injection holes, and a fuel rectified and accelerated by means of the guide path flows into a swirl chamber. The fuel forms a swirling flow in the swirl chamber and swirls within the injection hole; then, a fuel spray injected through the outlet of an injection hole plate becomes hollow and cylindrical fuel spray, so that atomization is allegedly facilitated.

Additionally, in prior arts disclosed in Japanese Patent Application Laid-Open No. 2006-2620, Japanese Patent Application Laid-Open No. 2006-336577, and Japanese Patent Application Laid-Open No. 2007-182767, the fuel flow is controlled based on the relationship between the shape of the fuel chamber and the position of the injection hole and a swirling flow is induced at the injection hole inlet, so that atomization is allegedly facilitated.

Meanwhile, in the prior arts disclosed in Japanese Patent Application Laid-Open No. 2003-336562 and Japanese Patent Application Laid-Open No. 2003-336563, a fuel injection valve is configured in such a way that respective guide paths are provided for the injection holes, and a fuel rectified and accelerated by means of the guide path flows into a swirl chamber; therefore, there have been such problems as described below.

[Effect on Flow Rate Characteristics]

In the foregoing prior arts, because the fluid resistance is large at the downstream side of a valve seat, the pressure reducing speed is low at the downstream side of the valve seat during the valve body closing process; therefore, because the valve closing delay time in which a valve closing signal is input and then the valve body is completely closed is long, the flow rate dynamic range is deteriorated.

[Effect on Fuel Spray Characteristics]

Because the fluid resistance is large at the downstream side of the valve seat, the fuel spray injected through the injection hole is liable to adhere; therefore, there may be caused a splashing phenomenon in which the fuel that has not been able to separate from the injection hole and has adhered to the endface, of the injection hole plate, in the vicinity of the injection hole outlet is splashed when the next injection is performed, whereby inferior fuel spray is injected outside the target injection zone; as a result, fuel adhesion to various parts of the engine increases, whereby exhaust gas and the controllability in the engine output may be deteriorated.

[Effect of Atmospheric Change]

Under a high-temperature and negative-pressure condition, due to vaporization of part of fuel in a so-called dead volume, a gas-liquid two-layer flow is caused, and the pressure loss is large when the gas-liquid two-layer flow passes through a narrow flow path; in the example of prior art, because the flow path is configured in such a way that the guide path, i.e., a diaphragm is provide from the downstream side of the valve seat to the injection hole, there has been a problem that, due to change in the temperature or the atmospheric pressure, the flow rate characteristics (static flow rate/dynamic flow rate) and the fuel spray characteristics (fuel spray shape/fuel-spray particle diameter) change considerably.

[Production Cost]

Because the speed of the fuel that flows into each swirl chamber depends on the shape of the guide path, the variation in the shape of the guide path largely affects the deviation of the injection amount of the fuel injected through the injection hole; therefore, a guide path having a high-accuracy shape is required, whereby the production cost is raised. When the deviation of the injection amount is large, the shape of the fuel spray varies, whereby, when the fuel is injected in the engine, the adhesion amount in various part of the engine and the distribution of the fuel-air mixture vary; therefore, the variation in combustion may cause an increase in the amount of exhaust gas or a fluctuation of the engine rotation.

In order to reduce the thickness of fuel liquid film so as to atomize the fuel spray, it is required to exert large swirling force on the fuel in the injection hole. In order to reinforce the swirling force in the swirl chamber, it is required to enlarge the offset between the injection hole inlet and the fuel path; thus, the ratio of depth to width of the fuel path becomes large. Accordingly, the machining of the fuel path becomes difficult, and in the case where the fuel path is formed with a press machine, there has been a problem that the lifetime of the die is shortened and hence the production cost increases.

In the case where a multi-hole injector is adopted for the purpose of further atomizing the fuel spray, the diameter of each injection hole becomes small and hence the fuel path becomes narrow, whereby the machining of the fuel path becomes difficult; therefore, in the case where the fuel path is formed with a press machine, there has been a problem that the lifetime of the die is shortened and hence the production cost increases.

In the prior arts disclosed in Japanese Patent Application Laid-Open No. 2006-2620 and Japanese Patent Application Laid-Open No. 2006-336577, a fuel injection valve is configured in such a way that the fuel flow is controlled based on the relationship between the shape of the fuel chamber and the position of the injection hole and a swirling flow is induced at the injection hole inlet; thus, there have been such problems as described below.

[Effect on Fuel Spray Characteristics]

Because the fuel injection valve according to the foregoing prior arts has no swirl chamber and has a flow opposite to the swirling flow, there has been a problem that the swirling flow does not develop sufficiently and hence the atomization is not facilitated.

In the mechanism in which swirling force is exerted on a fuel so as to atomize the fuel, it is important that the fuel is pressed against the inner wall of the injection hole while swirling within the injection hole so that the fuel is not filled in the injection hole but becomes thin liquid films and is injected in a hollow form through the injection hole outlet, and then the hollow liquid films spread due to centrifugal force, so that the liquid films become thinner, and due to shearing force exerted by air, the liquid films are split. With regard to the shape of a fuel chamber according to the prior arts, at the upstream side of the injection hole, there is provided a shape with which the fuel flow separates from the rest, and the separation of the fuel causes a disturbance in the flow. When the injected hollow liquid films spread due to centrifugal force, there exists a disturbance in the fuel flow in the case of the foregoing prior arts; therefore, the liquid film is split, with the thickness thereof kept thick, in process of spreading. There has been a problem that, because the split liquid thread or liquid drop is not likely to further split, the fuel cannot readily be atomized.

[Effect on Variation in Characteristics]

The flow path is made in such a way that, in the fuel chamber at the upstream side of the injection hole, the fuel flow separates from the rest; therefore, there has been a problem that, due to the disturbance in the separated fuel, the flow rate characteristics and the fuel spray characteristics are likely to vary.

[Effect of Atmospheric Change]

Under a high-temperature and negative-pressure condition, the fuel separation makes the fuel tend to boil under reduced pressure; therefore, there has been a problem that, due to atmospheric change, the flow rate characteristics (static flow rate/dynamic flow rate) and the fuel spray characteristics (fuel spray shape/fuel-spray particle diameter) change considerably.

Also in the prior art disclosed in Japanese Patent Application Laid-Open No. 2007-182767, the fuel flow is controlled based on the relationship between the shape of the fuel chamber and the position of the injection hole and a swirling flow is induced at the injection hole inlet; thus, there has been such a problem described below.

[Effect on Fuel Spray Characteristics]

Because the fuel injection valve according to the foregoing prior art has no swirl chamber and has a flow opposite to the swirling flow, there has been a problem that the swirling flow does not develop sufficiently and hence the atomization is not facilitated.

SUMMARY OF THE INVENTION

The present invention has been implemented in order to solve the foregoing problems.

The present invention provides a fuel injection valve in which a valve body for opening and closing a valve seat is provided, and by receiving an operation signal from a control device so as to operate the valve body, a fuel passes a gap between the valve body and a valve seat portion and then is injected through a plurality of injection holes provided in an injection hole plate mounted in a valve seat opening portion at the downstream side of the valve seat. In the fuel injection valve, the injection hole plate is disposed in such a way that an extended line along the plane of the valve seat portion of the valve seat whose diameter is gradually reduced in the downstream direction and an upstream plane of the injection hole plate intersect each other so that a virtual circle is formed; by recessing part of the upstream side of the injection hole plate at a plurality of positions along the valve seat opening portion, a plurality of fuel chambers is formed; the fuel chamber has a shape, the halves of which are symmetric with each other with respect to a line that radially extends from the center of the injection hole plate, and is disposed in a place that ranges from the inside of the virtual circle to the outside of the inner circumference of the valve seat opening portion; and in each of the fuel chambers, two injection holes are arranged outside the inner circumference of the valve seat opening portion in such a way as to flank the radial center line of the fuel chamber.

The present invention provides another fuel injection valve in which a valve body for opening and closing a valve seat is provided, and by receiving an operation signal from a control device so as to operate the valve body, a fuel passes a gap between the valve body and a valve seat portion and then is injected through a plurality of injection holes provided in an injection hole plate mounted in a valve seat opening portion at the downstream side of the valve seat. In the fuel injection valve, the injection hole plate is disposed in such a way that an extended line along the plane of the valve seat portion of the valve seat whose diameter is gradually reduced in the downstream direction and an upstream plane of the injection hole plate intersect each other so that a virtual circle is formed; by recessing part of the upstream side of the injection hole plate at a plurality of positions along the valve seat opening portion, a plurality of ellipsoidal fuel chambers is formed; the fuel chamber whose major axis is slanted with respect to a line that radially extends from the center of the injection hole plate is disposed in a place that ranges from the inside of the virtual circle to the outside of the inner circumference of the valve seat opening portion; and the injection hole solely provided in the fuel chamber is disposed outside the inner circumference of the valve seat opening portion.

The present invention provides another fuel injection valve in which a valve body for opening and closing a valve seat is provided, and by receiving an operation signal from a control device so as to operate the valve body, a fuel passes a gap between the valve body and a valve seat portion and then is injected through a plurality of injection holes provided in an injection hole plate mounted at the downstream side of the valve seat. In the fuel injection valve, on the circumference of the valve body situated in the vicinity of a valve seat guide portion, for guiding the valve body, that is provided at the upstream side of the valve seat portion, there is formed a plurality of grooves that serve as fuel paths, in such a way as to be slanted by a predetermined angle with respect to the center axis of the valve body and so as to become swirling grooves; the injection hole plate is disposed in such a way that an extended line along the plane of the valve seat portion of the valve seat whose diameter is gradually reduced in the downstream direction and an upstream plane of the injection hole plate intersect each other so that a virtual circle is formed; by recessing part of the upstream side of the injection hole plate at a plurality of positions along the valve seat opening portion, a plurality of fuel chambers is formed; the fuel chamber is provided in a place that ranges from the inside of the virtual circle to the outside of the inner circumference of the valve seat opening portion; the injection hole solely provided in the fuel chamber is disposed outside the inner circumference of the valve seat opening portion; the wall face, of the fuel chamber, that is situated inside the virtual circle is in a shape of an arc, the halves of which are symmetric with each other with respect to a line that radially extends from the center of the injection hole plate; and the wall face, of the fuel chamber, that is situated outside the inner circumference of the valve seat opening portion is in a shape of an arc that is concentric with the injection hole.

A fuel injection valve, according to the present invention, configured in such a way as described above demonstrates the following effects.

[Effect on Flow Rate Characteristics]

A fuel injection valve according to the present invention is configured in such a way that, because the fluid resistance is small at the downstream side of the valve seat, the pressure reducing speed is high at the downstream side of the valve seat during the valve body closing process, and hence, because the valve closing delay time in which a valve closing signal is input and then the valve body is completely closed is short, improvement of the flow rate dynamic range is advantageously performed.

[Effect on Fuel Spray Characteristics]

The present invention demonstrates an effect in which, because the fluid resistance is small at the downstream side of the valve seat, the fuel spray injected through the injection hole is not liable to adhere, and hence, because the fuel spray is detached from the injection hole, the splashing phenomenon can be suppressed.

A fuel injection valve according to the present invention is configured in such a way that, after being pressed against the wall face, of the fuel chamber, which is inside of the virtual circle, the fuel along the valve seat portion flows along the inner wall of the fuel chamber, and then flows into the injection hole while swirling around the injection hole inlet. Accordingly, by being pressed against the injection hole inner wall while swirling within the injection hole, the fuel is not filled into the injection hole, but becomes a thin liquid film and is injected in a hollow form through the injection hole outlet.

In the present invention, the fuel flow is rectified and the swirling flow is reinforced in the fuel chamber; therefore, the centrifugal force in the injection hole is strong, whereby there is demonstrated an effect in which the injected hollow liquid film can be made further thinner. Moreover, the rectification in the fuel chamber suppresses disturbance; thus, when spreading due to the centrifugal force, the injected hollow liquid film does not burst in process of spreading with its thickness kept large; therefore, the thickness of the liquid film can further be reduced. Thus, there is demonstrated an effect in which, by bursting the liquid film, which has been made thin, by means of shearing force of air, atomization is facilitated.

[Effect of Atmospheric Change]

The present invention provides a flow path in which the fuel is not likely to break away; therefore, the fuel is not likely to undergo low-pressure boiling. Even if part of the fuel undergoes low-pressure boiling and an air-liquid double-layer flow occurs in the dead volume, the pressure loss due to the air-liquid double-layer flow is small, because the flow path in the present invention is configured in such a way that there exists no diaphragm between the downstream side of the valve seat and the injection hole; therefore, changes, due to atmospheric change, in the flow rate characteristics (static flow rate/dynamic flow rate) and the fuel spray characteristics (fuel spray shape/fuel-spray particle diameter) are small.

[Production Cost]

In a fuel injection valve according to the present invention, unlike the prior arts disclosed in Japanese Patent Application Laid-Open No. 2003-336562 and Japanese Patent Application Laid-Open No. 2003-336563, there exists no complex guide path; therefore, because the fuel chamber is in a simple shape, high-accuracy machining can be performed, whereby variations in the injection amount can be suppressed at low production costs.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiments 1 to 14 will be explained below; with regard to Embodiment 2 to 14, explanations for the constituent elements that are common to Embodiments 1 to 14 will be omitted, and what differ from Embodiment 1 will mainly be explained.

Embodiment 1

Corresponding to Claims 1 to 4

Figure 1:
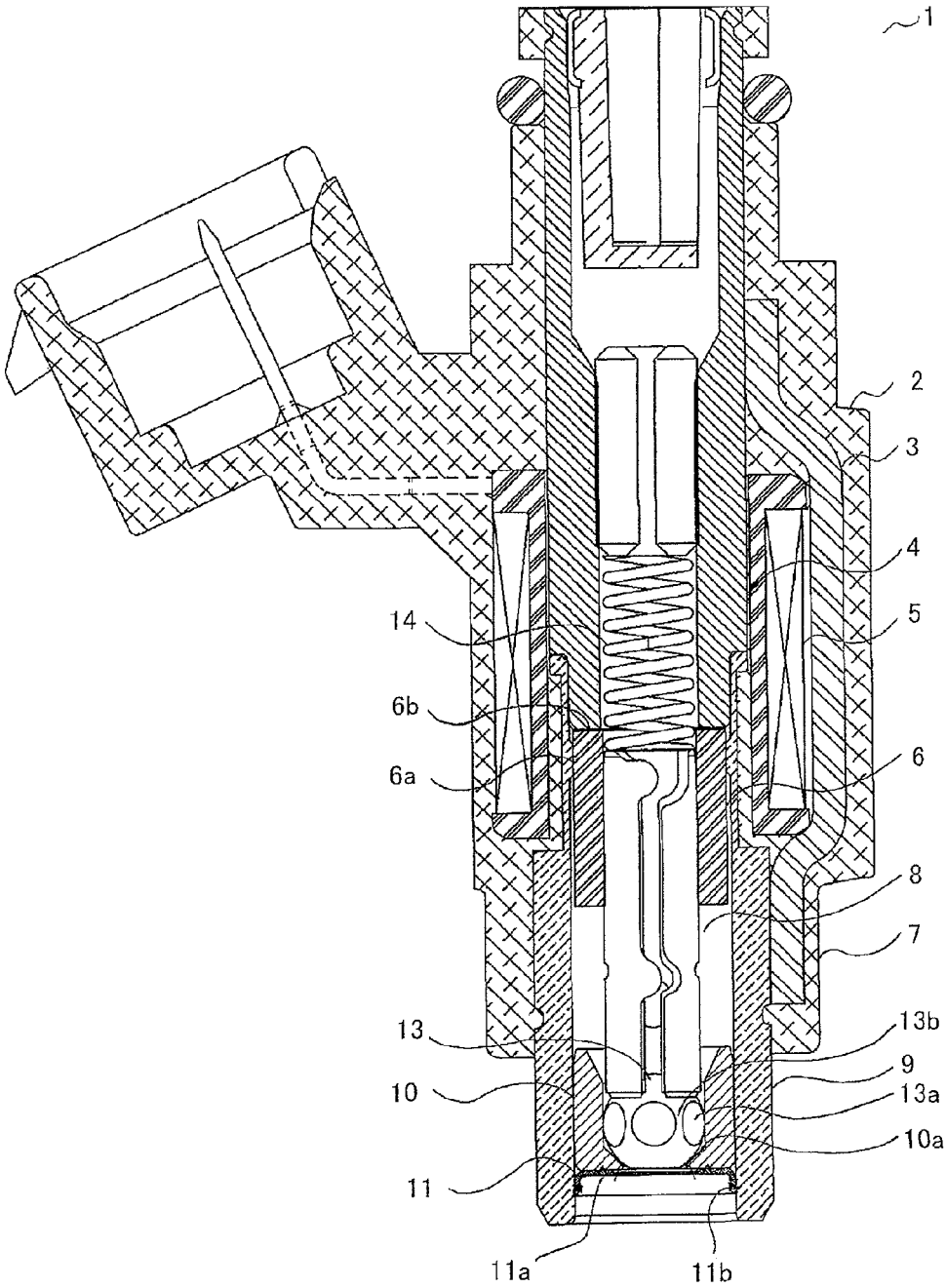
FIG. 1 is a cross-sectional view of a fuel injection valve according to Embodiment 1 of the present invention.
Figure 2:
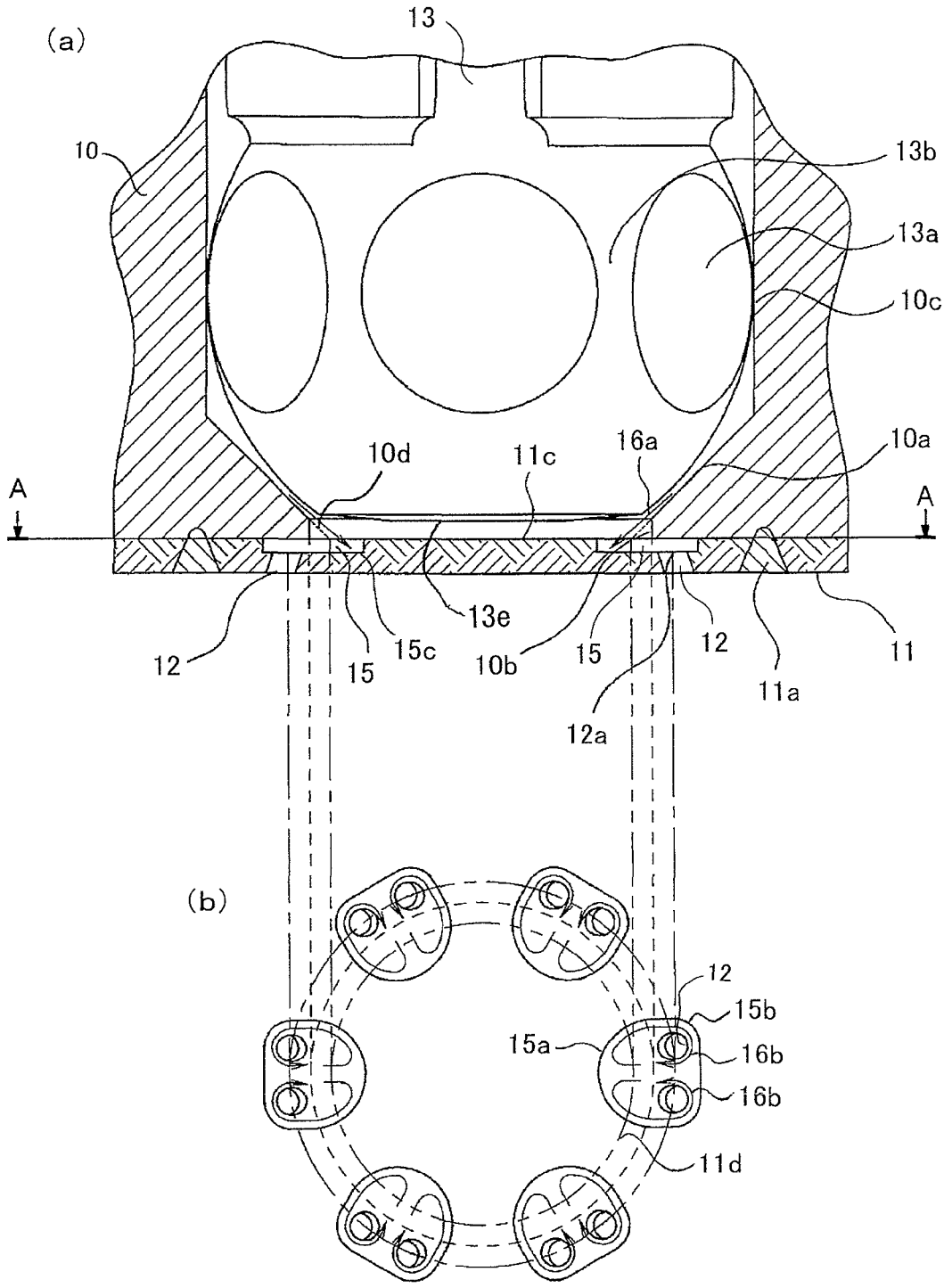
FIG. 2 is a set of cross-sectional view (a) and plan view (b) of the front end portion of a fuel injection valve according to Embodiment 1.

FIGS. 1 and 2 illustrate Embodiment 1 of the present invention; FIG. 1 is a cross-sectional view of a fuel injection valve; FIG. 2(*a*) is an enlarged cross-sectional view of the front end portion of a fuel injection valve; FIG. 2(*b*) is a plan view of the front end portion of a fuel injection valve in the case where the plane taken along the line A-A in FIG. 2(*a*) is viewed along the arrows.

A fuel injection valve 1 is provided with a solenoid device 2, a housing 3 that is a yoke portion of a magnetic circuit, a core 4 that is a fixed iron core portion of the magnetic circuit, a coil 5 wound around a bobbin provided on the circumference of the core 4, an armature 6 that is a moving iron core portion of the magnetic circuit, and a valve device 7. The valve device 7 is configured with a valve body 8, a valve main body 9, and a valve seat 10. At the front end of the valve body 8, a valve-body front end portion 13, which forms part of a sphere, is mounted, for example, through welding.

The valve main body 9 is pressure-fitted with the outer circumference of the core 4, and then welded to the core 4. The armature 6 is pressure-fitted with the valve body 8, and then welded to the valve body 8 so as to be integrally coupled with the valve body 8. A valve seat opening portion 10*b* is provided at a place where the diameter of the valve seat 10 is gradually reduced toward the downstream side. An injection hole plate 11 is inserted into the valve main body 9 in such a way as to be bonded with the bottom side of the valve seat 10 at a welding portion 11*a*; furthermore, the injection hole plate 11 is bonded with the valve main body 9 at a welding portion 11*b*.

In the injection hole plate 11, there are formed two or more fuel chambers 15 by recessing portions, at the upstream side, of the injection hole plate 11. A plurality of (six, in the case of FIG. 2) fuel chambers 15 is formed on a circumference along the valve seat opening portion 10*b*. At the bottom side 15*c* of each fuel chamber 15, two injection holes 12 are provided in such a way as to penetrate the bottom side 15*c*.

The valve-body front end portion 13 is formed in an approximately sphere shape, and the sphere portion is inserted into the valve seat 10 and faces the valve seat portion 10*a*. In peripheral portion, of the valve-body front end portion 13, which faces guide portion 10*c*, of the valve seat 10, that guides a sliding surface 13*b* of the valve-body front end portion 13 that moves in the valve seat 10, there are provided two or more grooves 13*a* in such a way as to be spaced evenly apart from one another.

When an engine control device transmits an operation signal to a drive circuit for the fuel injection valve 1, a current flows in the coil 5 of the fuel injection valve 1; magnetic flux is produced in a magnetic circuit including the armature 6, the core 4, the housing 3, and the valve main body 9; then, the armature 6 is attracted toward the core 4. The valve body 8 integrated with the armature 6 moves upward inside the valve main body 9. In this situation, the sliding surface 6*a* of the armature 6 and the valve main body 9 slide on each other; the sliding surface 13*b* of the valve-body front end portion 13 slides on the guide portion 10*c*, whereby the valve-body front end portion 13 is guided by the guide portion 10*c*.

When the valve is opened, an armature upper endface 6*b* makes contact with the bottom endface of the core 4. When the armature 6 moves to a valve-opening position, the valve-body front end portion 13 of the valve body 8 integrated with the armature 6 leaves the valve seat portion 10*a*, whereby a gap is formed. The fuel forms a fuel flow 16*a*; the fuel starts from each of the plurality of grooves 13*a* provided in the valve-body front end portion 13 and reaches the fuel chamber 15 through the gap between the valve seat portion 10*a* and the valve-body front end portion 13, and is injected through the plurality of the injection holes 12 into the air-intake pipe of the engine.

When the engine control device transmits an operation stop signal to the drive circuit of the fuel injection valve, power supply to the coil 5 is interrupted; magnetic flux in the magnetic circuit is reduced; a compression spring 14 that always presses the valve body 8 in a valve-closing direction closes the gap between the valve-body front end portion 13 and the valve seat portion 10*a*; then, the fuel injection ends. The sliding surface 6*a* of the valve body 8 slides on the valve main body 9, and the sliding surface 13*b* thereof slides on the guide portion 10*c*, whereby the valve body 8 is guided.

In Embodiment 1, as illustrated in FIG. 2, the injection hole plate 11 is disposed in such a way that an extended line 10*d* (indicated by a broken line) along the plane of the valve seat portion 10*a* of the valve seat 10 whose diameter is gradually reduced in the downstream direction and an upstream plane 11*c* of the injection hole plate 11 intersect each other so that a virtual circle 11*d* is formed, and by recessing part of the upstream side of the injection hole plate 11 at a plurality of positions which are spaced evenly apart from one another along the valve seat opening portion 10*b*, a plurality of fuel chambers 15 is formed.

The fuel chamber 15 is in a shape of an approximate heart, the halves of which are symmetric with each other with respect to a line that radially extends from the center of the injection hole plate 11, and disposed in a place that ranges from the inside of the virtual circle 11*d* to the outside of the inner circumference of the valve seat opening portion 10*b*; in each of the fuel chambers 15, a pair of (two) injection holes 12 are arranged at positions outside the inner circumference of the valve seat opening portion 10*b* in such a way as to flank the radial center line of the fuel chamber 15.

The shape of the fuel chamber 15 will be explained in more detail. A wall face 15*a* situated inside the virtual circle 11*d* of the fuel chamber 15 is formed of an arc, the halves of which are symmetric with each other with respect to a radial line that extends from the center of the injection hole plate 11; furthermore, wall faces 15*b* situated outside the inner circumference of the valve seat opening portion 10*b* of the fuel chamber 15 are each in the form of an arc that is concentric with the corresponding injection hole 12. In FIG. 2(*b*), the shape of the fuel chamber 15 is formed by connecting the respective ends of the two arcs.

Respective injection hole inlets 12*a* of the two injection holes 12 are arranged in such a way as to be symmetric with each other with respect to the radial center line of the corresponding fuel chamber 15. Each of the injection holes 12 penetrates the injection hole plate 11 in such a way as to has a given gradient with respect to a direction perpendicular to the injection hole plate 11. In FIG. 2(*b*), the injection holes 12 provided in the three fuel chambers 15 situated at the right-hand side with respect to the center line of the injection hole plate 11 are each formed in such a way as to slant to the right as they extend to the injection hole outlet; the injection holes 12 provided in the three fuel chambers 15 situated at the left-hand side with respect to the center line of the injection hole plate 11 are each formed in such a way as to slant to the left as they extend to the injection hole outlet.

In a fuel injection valve having such a structure as described above, the fuel passes through the groove 13*a* of the valve-body front end portion 13 and forms the fuel flow 16*a*; the fuel flow 16*a* from the valve seat portion 10*a* collides with the bottom side 15*c* of the fuel chamber 15; after that, the fuel flow 16*a* advances along the wall face 15*a* situated inside the inner circumference of the fuel chamber and ramifies into two flows that are symmetric with each other with respect to the corresponding radial center line of the fuel chamber 15; then, the fuel flows radially. After that, while advancing along the wall face 15*b* around the injection hole 12 of the fuel chamber, the fuel forms a swirling flow 16*b* with respect to the injection hole inlet 12*a*. The fuel that flows into the injection hole inlet 12*a* is injected through the downstream-side outlet of the injection hole 12 while swirling within the injection hole 12; therefore, because a hollow and conical fuel spray is formed, atomization is facilitated.

Embodiment 2

Corresponding to Claim 5

Figure 3:
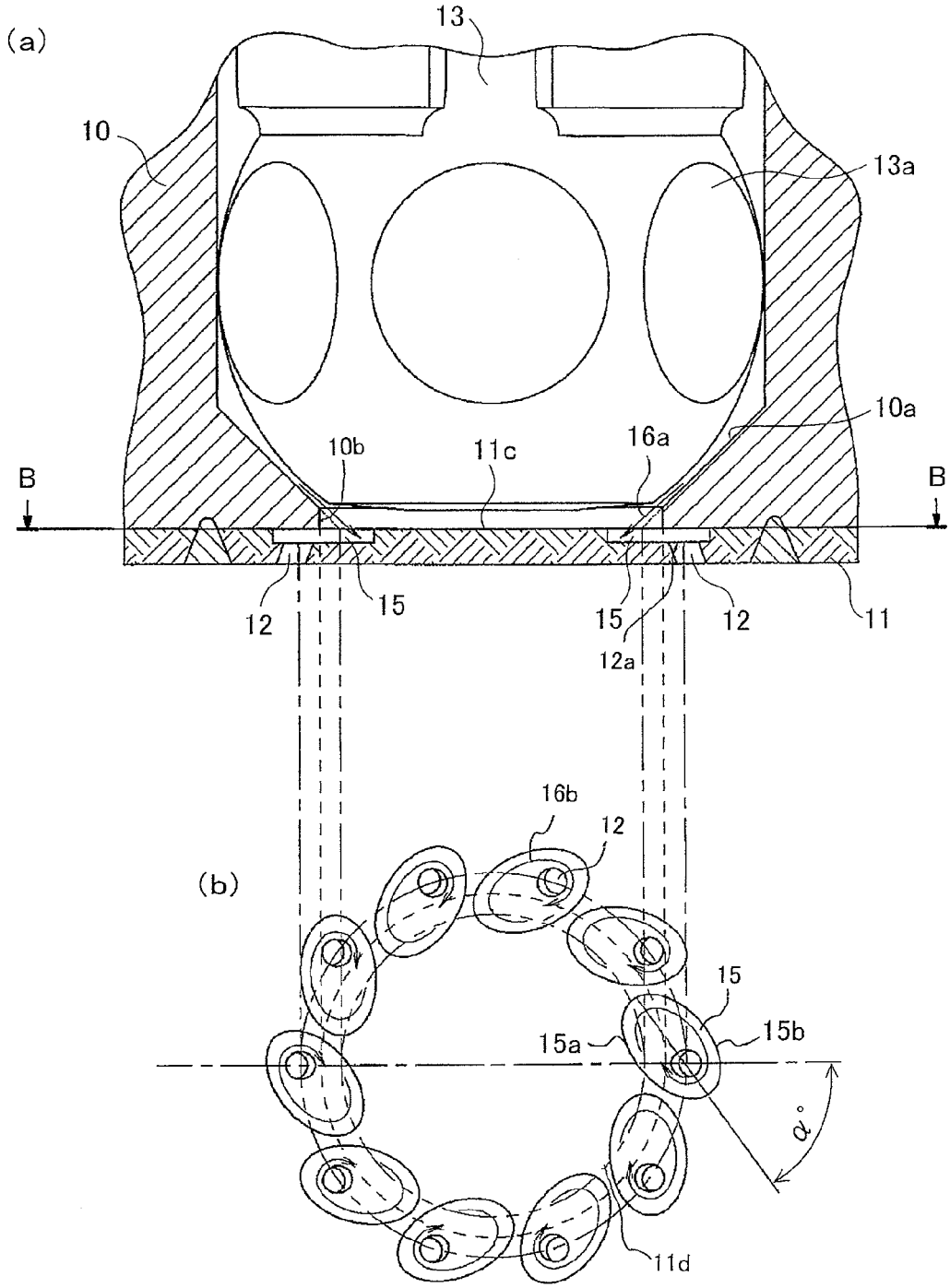
FIG. 3 is a set of cross-sectional view (a) and plan view (b) of the front end portion of a fuel injection valve according to Embodiment 2.

FIG. 3 illustrates the front end portion of a fuel injection valve according to Embodiment 2; FIG. 3(*a*) is a cross-sectional view of the front end portion; FIG. 3(*b*) is a plan view of the front end portion of a fuel injection valve in the case where the plane taken along the line B-B in FIG. 3(*a*) is viewed along the arrows. In Embodiment 2, fuel chambers 15 formed in an injection hole plate 11 are ellipsoidal; a single injection hole 12 is provided in each of the fuel chambers 15; the injection hole 12 is disposed outside the inner circumference of a valve seat opening portion 10*b*.

As illustrated in FIG. 3, two or more (ten, in the case of FIG. 3) fuel chambers 15 are provided in a place that ranges from the inside of a virtual circle 11*d* to the outside of the inner circumference of the valve seat opening portion 10*b*. The fuel chamber 15 is ellipsoidal; the major axis thereof is slanted by $\alpha°$ with respect to a radial line that extends from the center of the injection hole plate 11. Accordingly, both a wall face 15*a* inside a virtual circle 11*d* of the fuel chamber 15 and a wall face 15*b* outside the inner circumference of the valve seat opening portion 10*b* are slanted with respect to the radial line that extends from the center of the injection hole plate 11.

In such a structure as described above, the fuel passes through a groove 13*a* of a valve-body front end portion 13 and forms a fuel flow 16*a*; the fuel flow 16*a* from a valve seat portion 10*a* flows to the center of the injection hole plate 11; however, because the wall face 15*a* inside a virtual circle 11*d* of the fuel chamber 15 is slanted with respect to the fuel flow 16*a* that heads toward the center of the injection hole plate 11, the fuel forms a unidirectional swirling flow 16*b* in the fuel chamber 15 and flows into an injection hole inlet 12*a*. Therefore, the fuel becomes hollow and conical fuel spray, whereby atomization is facilitated. The configurations other than those described above are the same as those of Embodiment 1; therefore, explanations therefor will be omitted.

Embodiment 3

Corresponding to Claims 6 to 8

Figure 4:
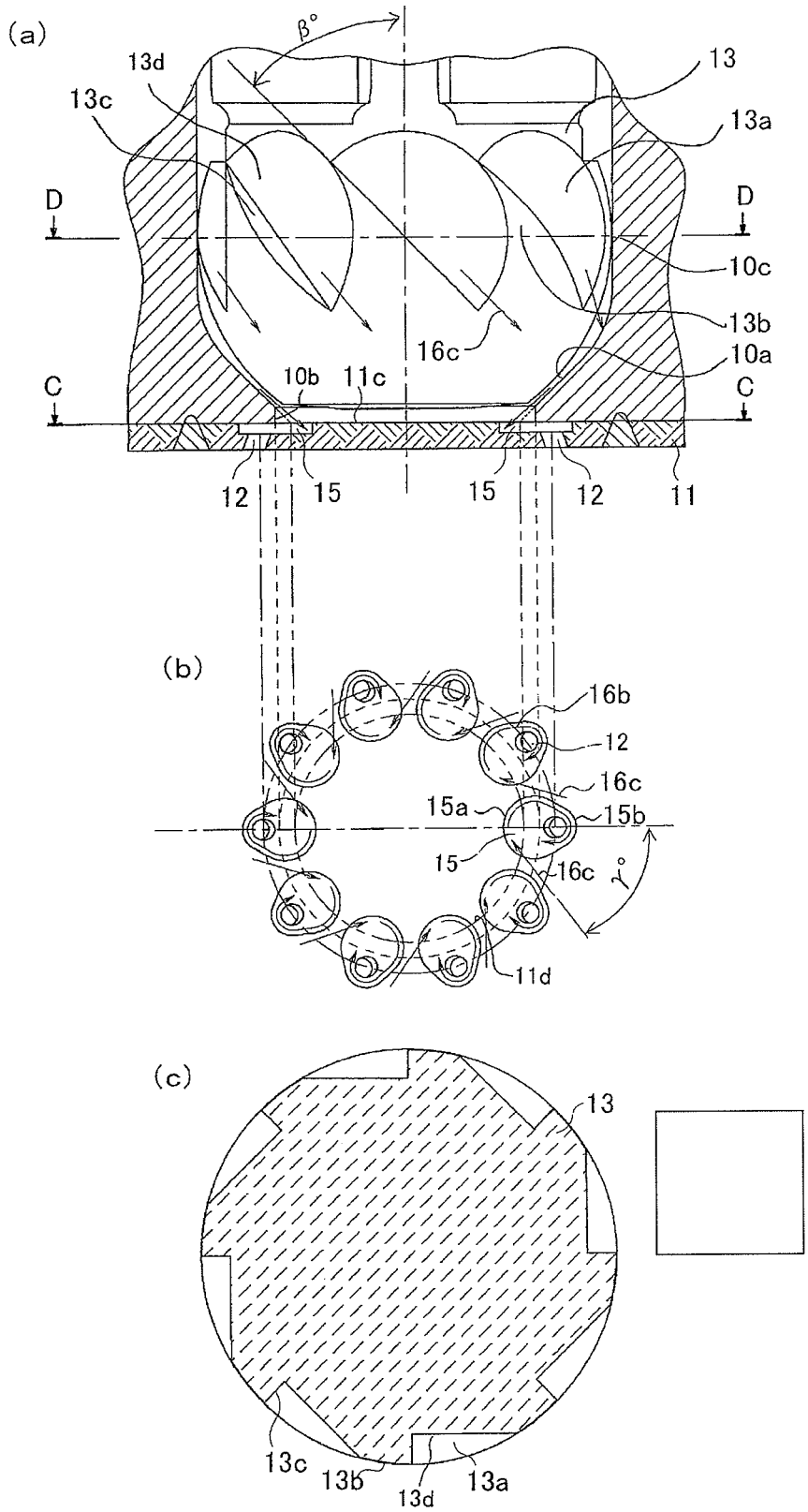
FIG. 4 is a set of cross-sectional view (a), plan view (b), and cross-sectional plan view (c) of the front end portion of a fuel injection valve according to Embodiment 3.

FIG. 4 illustrates the front end portion of a fuel injection valve according to Embodiment 3; FIG. 4(*a*) is a cross-sectional view of the front end portion; FIG. 4(*b*) is a plan view of the front end portion of a fuel injection valve in the case where the plane taken along the line C-C in FIG. 4(*a*) is viewed along the arrows; FIG. 4(*c*) is a cross-sectional view, taken along the line D-D, of the front end portion of a fuel injection valve. In Embodiment 3, the structure of a valve-body front end portion 13 and a fuel chamber 15 are different from those in Embodiment 1.

In Embodiment 3, as illustrated in FIG. 4, a plurality of grooves 13*a* is formed in such a way as to be spaced evenly apart from one another in a sphere-shaped peripheral portion of the valve-body front end portion 13; each of the grooves 13*a* is formed of a semicircle-shaped plane 13*d* and another plane 13*c* that intersects the plane 13*d*. The plane 13*c* is provided in such a way as to be slanted by a predetermined angle $\beta$ with respect to the center axis of a valve body 8 and forms a swirling groove that serves as a fuel path.

The inner wall of a valve seat 10 in the vicinity of the portion where a valve seat portion 10*a* and a guide portion 10*c* are connected, i.e., in the vicinity of the outlet of the swirling groove formed of the plane 13*c* has a curved surface of a curvature R.

On the other hand, a fuel chamber 15 is approximately egg-shaped and provided in a place that ranges from the inside of a virtual circle 11*d* to the outside of the inner circumference of a valve seat opening portion 10*b*; in each of the fuel chambers 15, a single injection hole 12 is disposed outside the inner circumference of the valve seat opening portion 10*b*. A wall face 15*a*, inside the virtual circle 11*d*, of the fuel chamber 15 is formed in the form of an arc, the halves of which are symmetric with each other with respect to a radial line from the center of an injection hole plate 11; a wall face 15*b* situated outside the inner circumference of the valve seat opening portion 10*b* of the fuel chamber 15 is in the form of an arc that is concentric with the corresponding injection hole 12.

In a fuel injection valve having such a structure as described above, due to the plane 13*c* of the valve-body front end portion 13, a fuel flow 16*c* flows into the fuel chamber 15 in such a way as to be slanted by $\gamma°$ with respect to a radical line that extends from the center of the injection hole plate 11; therefore, the fuel forms a unidirectional swirling flow 16*b* in the fuel chamber 15 and flows into an injection hole inlet 12*a*. As a result, at the injection hole outlet, the fuel becomes hollow and conical fuel spray, whereby atomization is facilitated. In this situation, an effect is demonstrated in which the curved-surface portion of the valve seat 10 maintains the swirling flow 16*c* formed by the plane 13*c*. The configurations other than those described above are the same as those of Embodiment 1; therefore, explanations therefor will be omitted.

Embodiment 4

Corresponding to Claim 9

Figure 5:
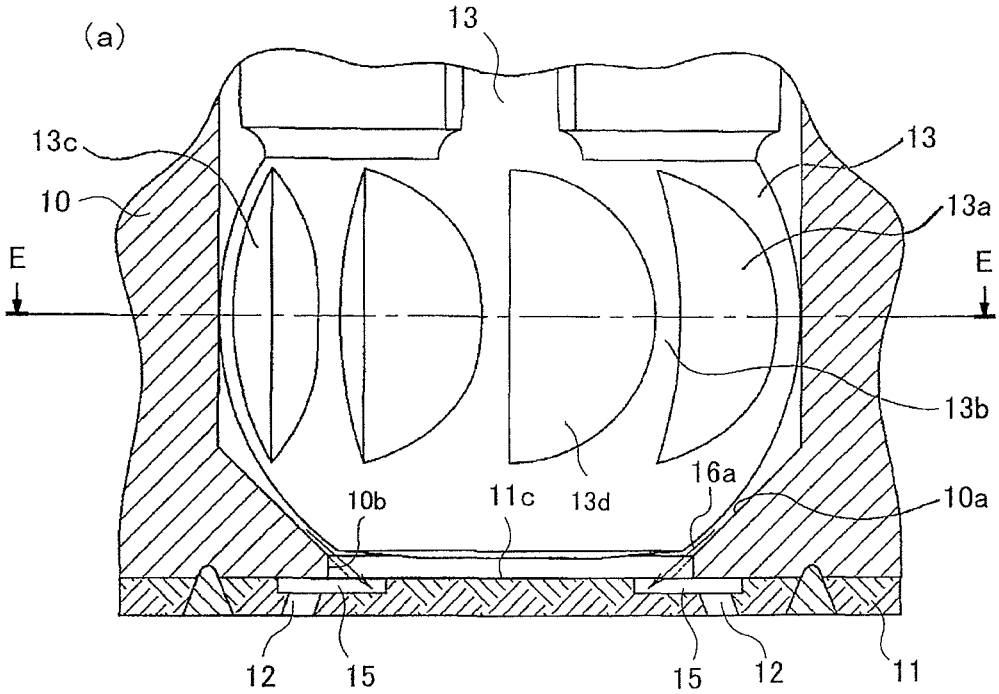
FIG. 5 is a set of cross-sectional view (a) and plan view (b) of the front end portion of a fuel injection valve according to Embodiment 4.
Figure 5:
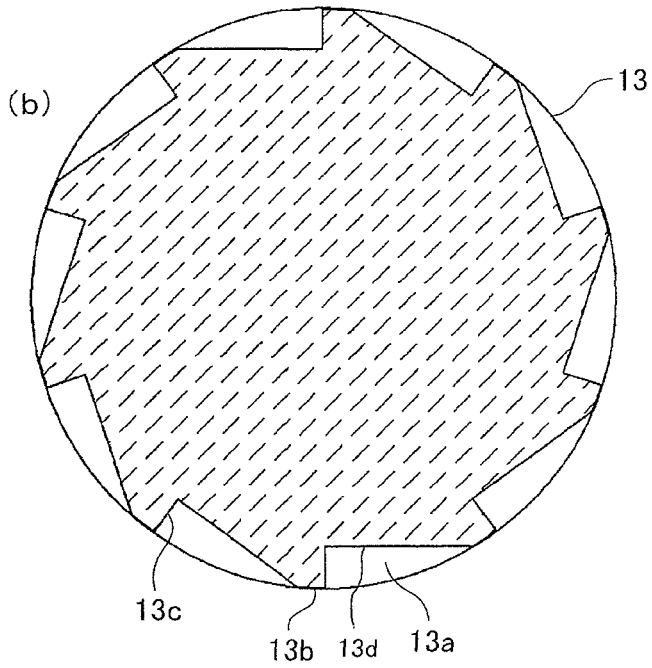

FIG. 5 illustrates the front end portion of a fuel injection valve according to Embodiment 4; FIG. 5(*a*) is a cross-sectional view of the valve-body front end portion; FIG. 5(*b*) is a cross-sectional view of the valve-body front end portion, as viewed along E-E in FIG. 5(*a*). In Embodiment 4, as illustrated in FIG. 5, a groove 13*a* is formed in a sphere-shaped peripheral portion of the a sphere-shaped valve-body front end portion 13; the groove 13*a* has an approximately semicircle-shaped plane 13*d* and another plane 13*c* that intersects the plane 13*d*. Both the planes 13*c* and 13*d* form a fuel path that is parallel to the axis center of the valve body 8; a plurality of the fuel paths are provided in and around the valve-body front end portion 13 in such a way as to be spaced evenly apart from one another.

Because a plurality of fuel paths can be formed by means of the groove 13*a* formed of the planes 13*d* and 13*c*, fuel flows 16*a* from a valve seat portion 10*a* can be circumferentially homogenized. As a result, the fuel homogeneously and evenly flows into respective fuel chambers 15, and the fuel flow in the fuel chamber 15 is stabilized; therefore, there can be expected an effect in which variations in the fuel spray are suppressed. The fuel chamber 15 is the same as that in Embodiment 1 or Embodiment 2. The other configurations are the same as those of Embodiment 1; therefore, explanations therefor will be omitted.

Embodiment 5

Corresponding to Claim 10

Figure 6:
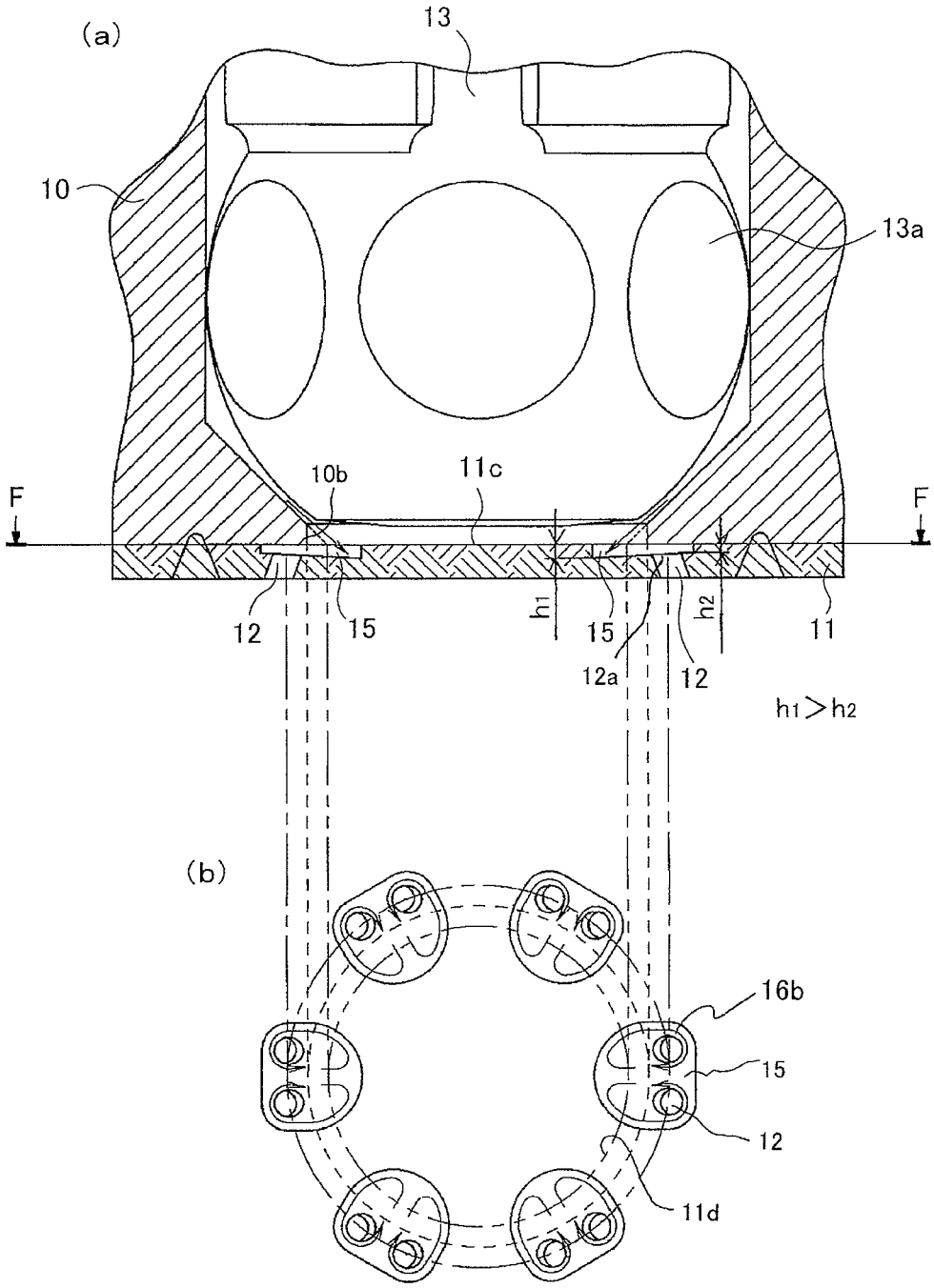
FIG. 6 is a set of cross-sectional view (a) and plan view (b) of the front end portion of a fuel injection valve according to Embodiment 5.

FIG. 6 illustrates the front end portion of a fuel injection valve according to Embodiment 5; FIG. 6(*a*) is a cross-sectional view of the valve-body front end portion; FIG. 6(*b*) is a plan view of the front end portion of a fuel injection valve in the case where the plane taken along the line F-F in FIG. 6(*a*) is viewed along the arrows. In Embodiment 5, as illustrated in FIG. 6, letting h1 denote the depth, at the inner circumference side of an injection hole plate 11, of a fuel chamber 15 and h2 denote the depth, at the outer circumference side of the injection hole plate 11, of a fuel chamber 15, h1 is made larger than h2. In other words, the depth of the fuel chamber is gradually shallowed toward the vicinity of an injection hole 12. As described above, the cross-sectional area of the fuel chamber 15 is gradually decreased toward the injection hole 12; a swirling flow 16*b* around an injection hole inlet 12*a* is accelerated; then, the swirling force exerted on the fuel is reinforced. Accordingly, because the thickness of the injected hollow liquid film can be further decreased, there is demonstrated an effect in which atomization is facilitated. The configurations other than those described above are the same as those of Embodiment 1; therefore, explanations therefor will be omitted.

Embodiment 6

Corresponding to Claim 11

Figure 7:
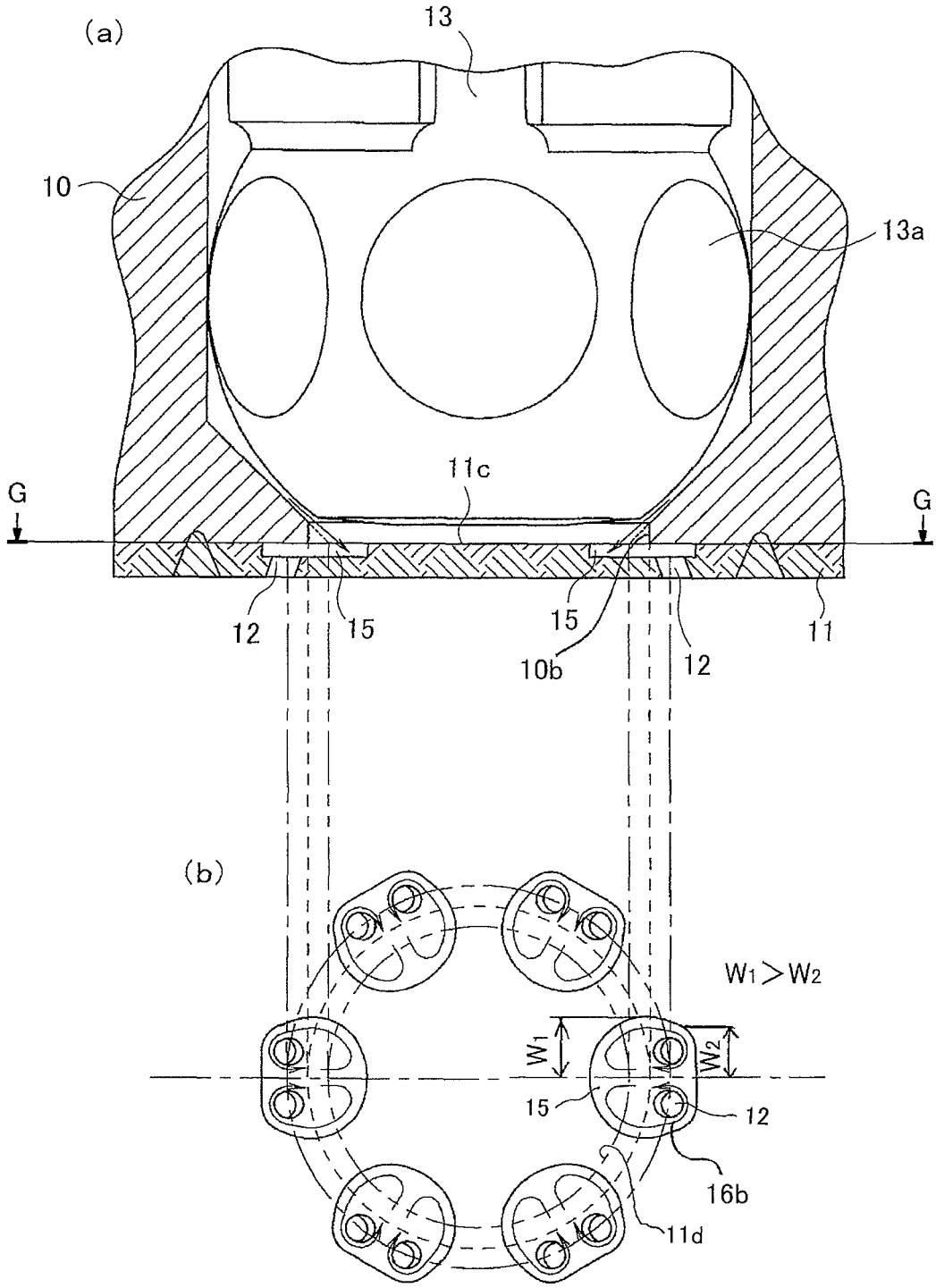
FIG. 7 is a set of cross-sectional view (a) and plan view (b) of the front end portion of a fuel injection valve according to Embodiment 6.

FIG. 7 illustrates the front end portion of a fuel injection valve according to Embodiment 6; FIG. 7(*a*) is a cross-sectional view of the valve-body front end portion; FIG. 7(*b*) is a plan view of the front end portion of a fuel injection valve in the case where the plane taken along the line G-G in FIG. 7(*a*) is viewed along the arrows. In Embodiment 6, as illustrated in FIG. 7, the sidewall width of a fuel chamber 15 is gradually decreased toward the vicinity of an injection hole 12 in such a way that the width thereof at a position on the inner circumference of a valve seat opening portion 10*b* is W1×2 and that the width thereof at a position outside the outer circumference of a valve seat opening portion 10*b* is W1×2 (W1>W2).

In such a way as described above, the cross-sectional area of the fuel chamber 15 is gradually decreased toward the injection hole 12; therefore, because, as is the case with Embodiment 5, the swirling force exerted on a swirling flow 16*b* is reinforced, there is demonstrated an effect in which atomization is facilitated. The configurations other than those described above are the same as those of Embodiment 1; therefore, explanations therefor will be omitted.

Embodiment 7

Corresponding to Claim 12

In Embodiment 7, a fuel chamber 15 is formed through coining on a conveyer line utilized during manufacturing of an injection hole plate. Accordingly, because there can readily be secured the accuracy of the position of an injection hole in the fuel chamber 15, variations in fuel spray can be suppressed at low production costs.

Embodiment 8

Corresponding to Claim 13

Figure 8:
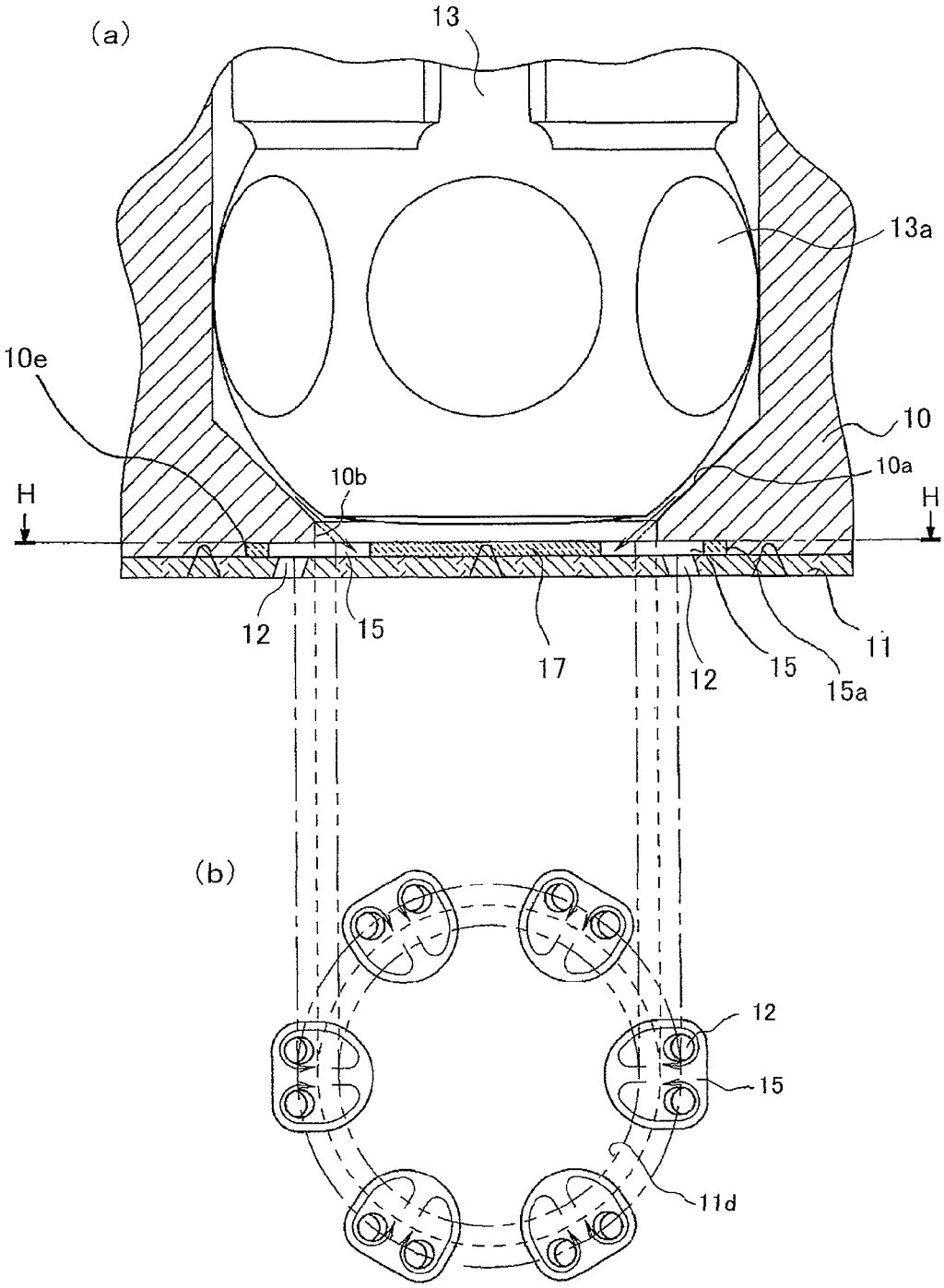
FIG. 8 is a set of cross-sectional view (a) and plan view (b) of the front end portion of a fuel injection valve according to Embodiment 8.

FIG. 8 illustrates the front end portion of a fuel injection valve according to Embodiment 8; FIG. 8(*a*) is a cross-sectional view of the valve-body front end portion; FIG. 8(*b*) is a plan view of the front end portion of a fuel injection valve in the case where the plane taken along the line H-H in FIG. 8(*a*) is viewed along the arrows. In Embodiment 8, as illustrated in FIG. 8, an intermediate plate 17 is provided between a valve seat 10 and an injection hole plate 11.

A fuel chamber 15 is formed in the intermediate plate 17 through press machining; in the injection hole plate 11, there is formed only an injection hole 12. After the positions of an injection hole inlet 12*a* and the fuel chamber 15 are adjusted, the intermediate plate 17 and the injection hole plate 11 are welded with each other. The diameter of the intermediate plate 17 is made smaller than that of the injection hole plate 11; the intermediate plate 17 is inserted into recesses 10*e* formed by recessing the downstream side endface of the valve seat by the thickness of the intermediate plate 17.

Because the intermediate plate 17 is provided, the thickness of the injection hole plate 11 can be reduced. Accordingly, because, when the injection hole plate 11 is welded with the valve seat 10, the amount of welding heat can be reduced, the thermal deformation in a valve seat portion 10*a* is suppressed; therefore, there can be expected an effect in which the gastightness of the valve is raised. The shape of the fuel chamber 15 is the same as that in any one of Embodiments 1 to 6. The other configurations are the same as those of Embodiment 1; therefore, explanations therefor will be omitted.

Embodiment 9

Corresponding to Claim 14

Figure 9:
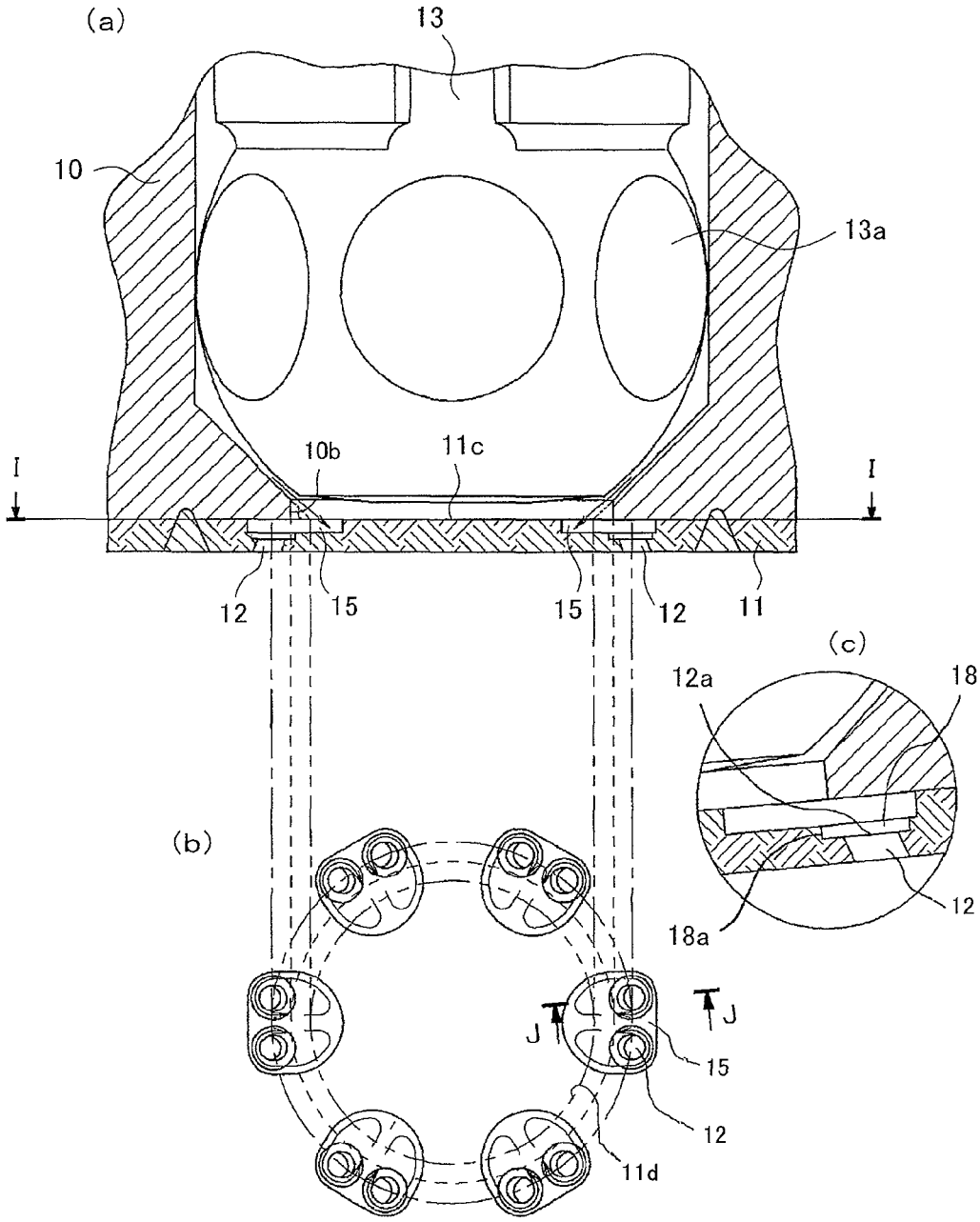
FIG. 9 is a set of cross-sectional view (a), plan view (b), and principal-part enlarged view of the front end portion of a fuel injection valve according to Embodiment 9.

FIG. 9 illustrates the front end portion of a fuel injection valve according to Embodiment 9; FIG. 9(*a*) is a cross-sectional view of the valve-body front end portion; FIG. 9(*b*) is a plan view of the front end portion of a fuel injection valve in the case where the plane taken along the line I-I in FIG. 9(*a*) is viewed along the arrows; FIG. 9(*c*) is an enlarged view of the cross section, taken along the line J-J, of the front end portion of a fuel injection valve. In Embodiment 9, as illustrated in FIG. 9, around an injection hole inlet 12*a*, there is provided a swirl chamber 18, which is a space having a cylindrical sidewall 18*a* whose diameter is larger than that of the injection hole inlet 12*a*, in such a way as to be concentric with an injection hole 12. Accordingly, because the whole circumference of the injection hole 12 is surrounded by a swirl chamber, the swirling effect is raised, whereby atomization is facilitated. The other configurations are the same as those of Embodiment 1; therefore, explanations therefor will be omitted.

Embodiment 10

Corresponding to Claim 15

Figure 10:
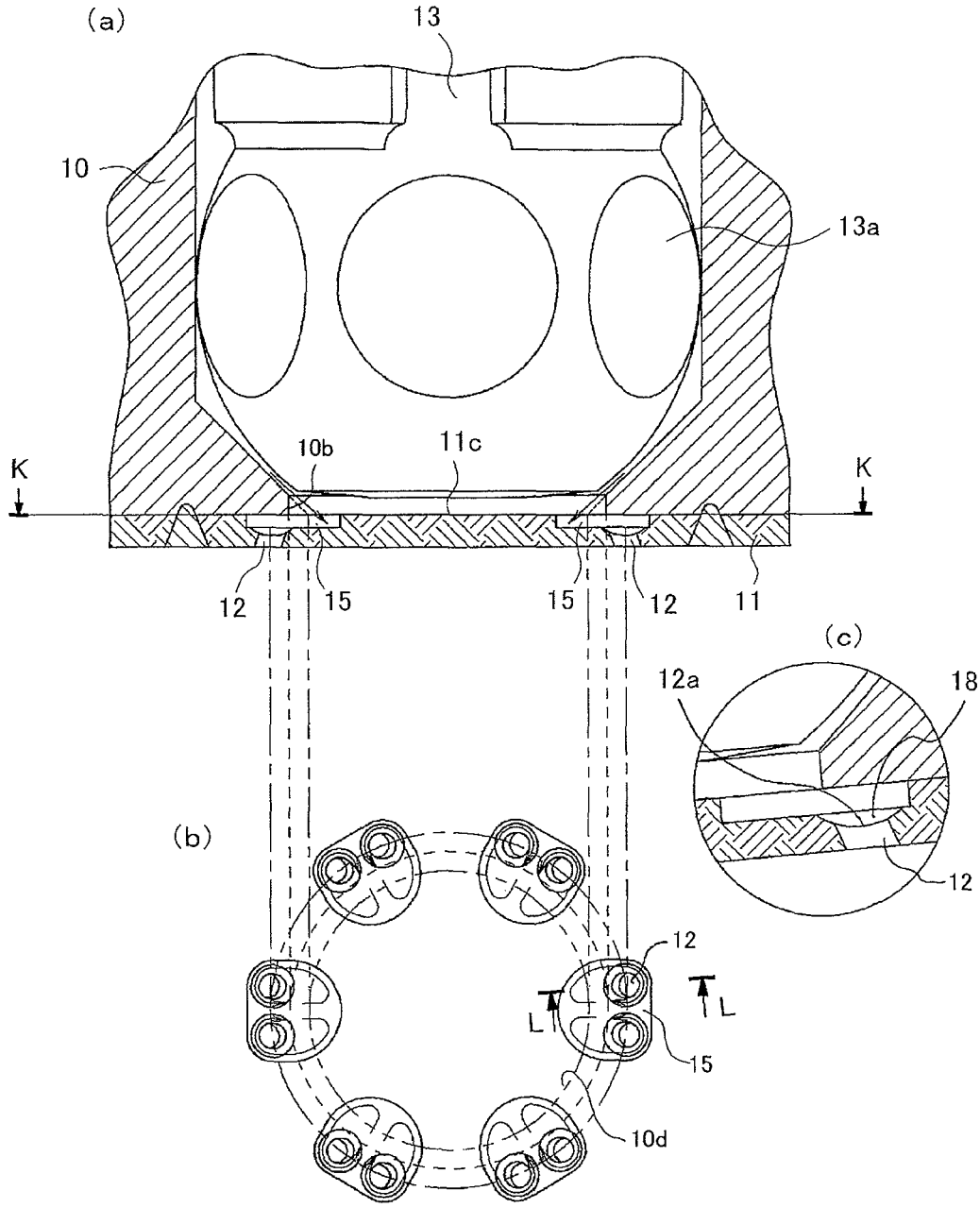
FIG. 10 is a set of cross-sectional view (a), plan view (b), and principal-part enlarged view of the front end portion of a fuel injection valve according to Embodiment 10.

FIG. 10 illustrates the front end portion of a fuel injection valve according to Embodiment 10; FIG. 10(*a*) is a cross-sectional view of the valve-body front end portion; FIG. 10(*b*) is a plan view of the front end portion of a fuel injection valve in the case where the plane taken along the line K-K in FIG. 10(*a*) is viewed along the arrows; FIG. 10(*c*) is an enlarged view of the cross section, taken along the line L-L, of the front end portion of a fuel injection valve. In Embodiment 10, as illustrated in FIG. 10, the cross section of a swirl chamber 18 is made spherical. Other constituent elements are the same as those in Embodiment 9.

As a result, because the fuel flow from the swirl chamber 18 to an injection hole 12 becomes smooth, there exists no loss in the fuel flow, whereby the swirling effect is raised; therefore, atomization is facilitated. Moreover, because the fuel evenly flows into the slanted injection hole 12, distortion of the fuel flow in the injection hole 12 can be suppressed; therefore, there can be expected an effect in which variations in the fuel spray are suppressed.

Embodiment 11

Corresponding to Claim 16

Figure 11:
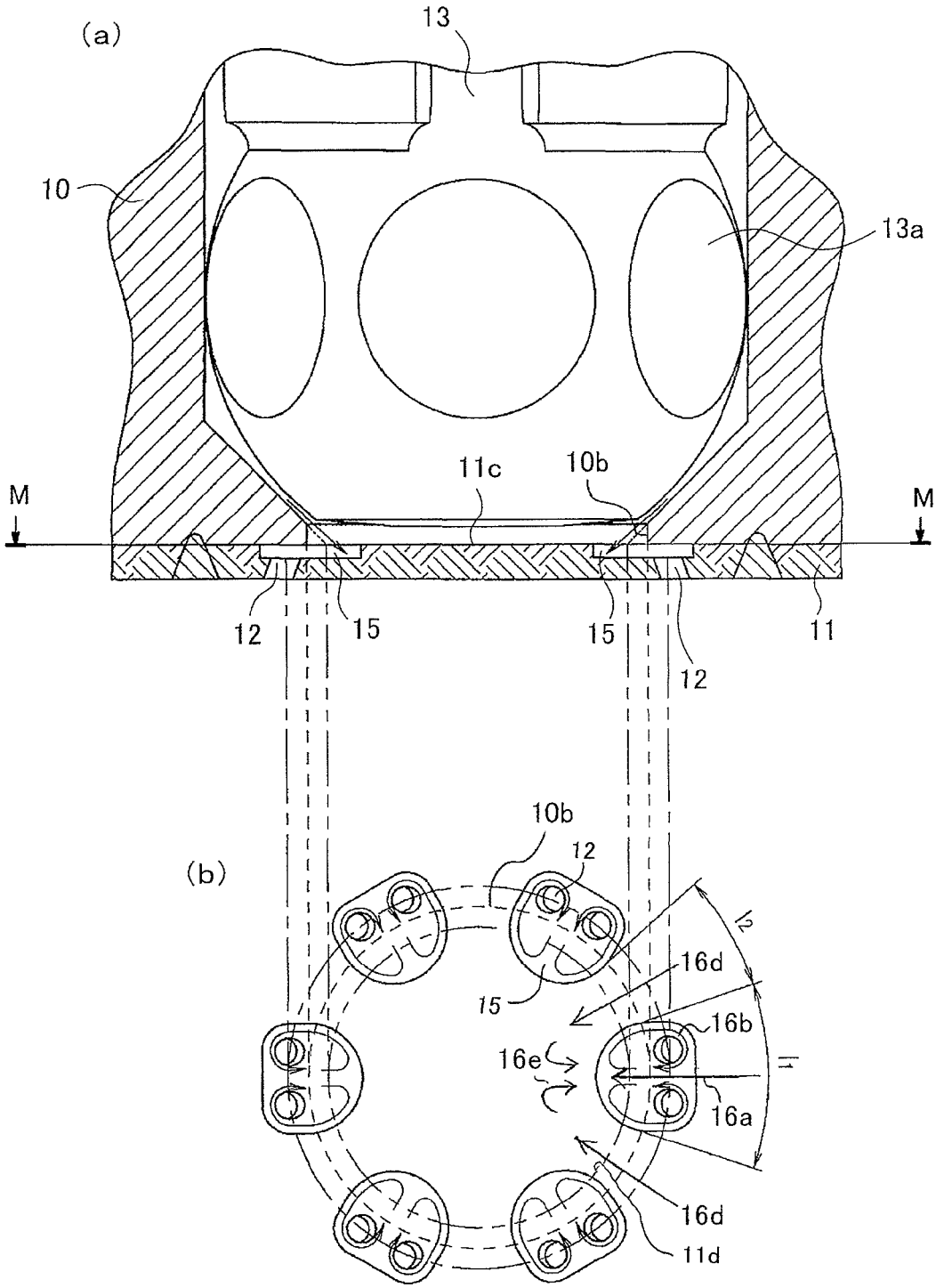
FIG. 11 is a set of cross-sectional view (a) and plan view (b) of the front end portion of a fuel injection valve according to Embodiment 11.

FIG. 11 illustrates the front end portion of a fuel injection valve according to Embodiment 11; FIG. 11(*a*) is a cross-sectional view of the valve-body front end portion; FIG. 11(*b*) is a plan view of the front end portion of a fuel injection valve in the case where the plane taken along the line M-M in FIG. 11(*a*) is viewed along the arrows. In Embodiment 11, as illustrated in FIG. 11, when a tangential line is drawn at a point where the sidewall of a fuel chamber 15 and a valve seat opening portion 10*b* intersect each other, the distance 11 between the tangential lines at a place where the fuel chamber 15 is formed is larger than the distance 12 between the tangential lines at a place where the fuel chamber 15 is not formed.

The foregoing configuration demonstrates an effect in which there are suppressed a fuel flow 16*d* that passes a place where the fuel chamber 15 is not formed and a fuel flow 16*e* that radially heads from the center of the fuel injection valve to the fuel chamber 15. The radial fuel flow 16*e* faces the fuel flow 16*a* that flows into a place where the fuel chamber 15 is formed; therefore, by suppressing the radial fuel flow 16*e*, the swirling force is reinforced, whereby there can be expected an effect in which atomization is facilitated. The other configurations are the same as those of Embodiment 1; therefore, explanations therefor will be omitted.

Embodiment 12

Corresponding to Claim 17

Figure 12:
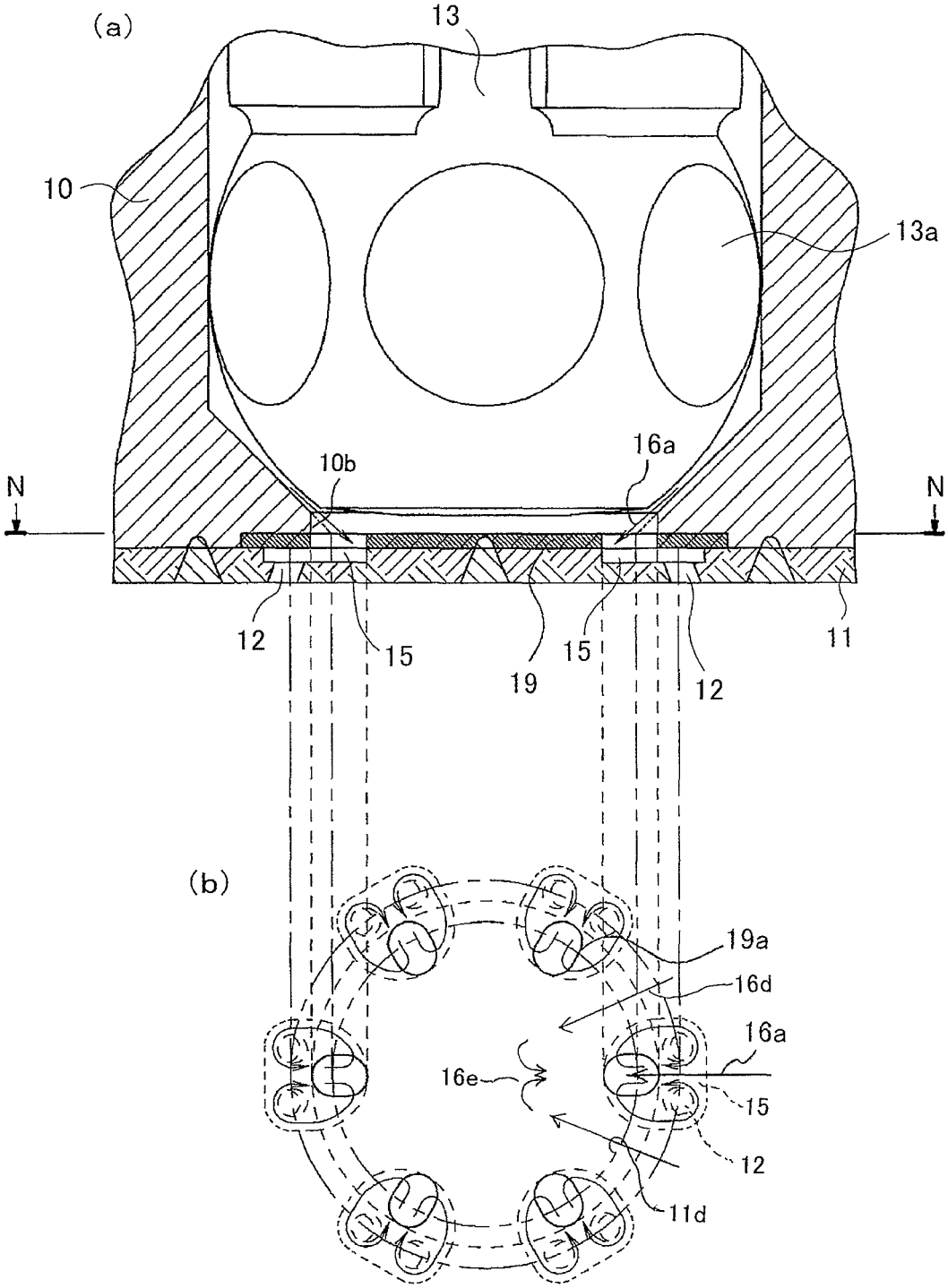
FIG. 12 is a set of cross-sectional view (a) and plan view (b) of the front end portion of a fuel injection valve according to Embodiment 12.

FIG. 12 illustrates the front end portion of a fuel injection valve according to Embodiment 12; FIG. 12(*a*) is a cross-sectional view of the valve-body front end portion; FIG. 12(*b*) is a plan view of the front end portion of a fuel injection valve in the case where the plane taken along the line N-N in FIG. 12(*a*) is viewed along the arrows. In Embodiment 12, as illustrated in FIG. 12, an intermediate plate 19 is provided between a valve seat 12 and an injection hole plate 11; in the intermediate plate 19, there is formed a nozzle hole 19*a* communicating with a fuel chamber 15.

The nozzle hole 19*a* has a shape, the halves of which are symmetric with each other with respect to a radial line that extends from the center of the injection hole plate 11; the nozzle hole 19*a* has a shape, the halves of which are symmetric with each other with respect to the radial center line of the fuel chamber 15 and which is elongated in the radial direction; the flow rate coefficient of the nozzle hole is sufficiently larger than that of the injection hole. The fuel flows into the fuel chamber 15 through the nozzle hole 19*a*.

Accordingly, there cab be suppressed a fuel flow 16*d* that passes a place where the fuel chamber 15 is not formed and a fuel flow 16*e* that radially heads from the center of the fuel injection valve to the fuel chamber 15; therefore, the swirling force is reinforced, whereby there can be expected an effect in which atomization is facilitated. The other configurations are the same as those of Embodiment 1; therefore, explanations therefor will be omitted.

Embodiment 13

Corresponding to Claim 18

Figure 13:
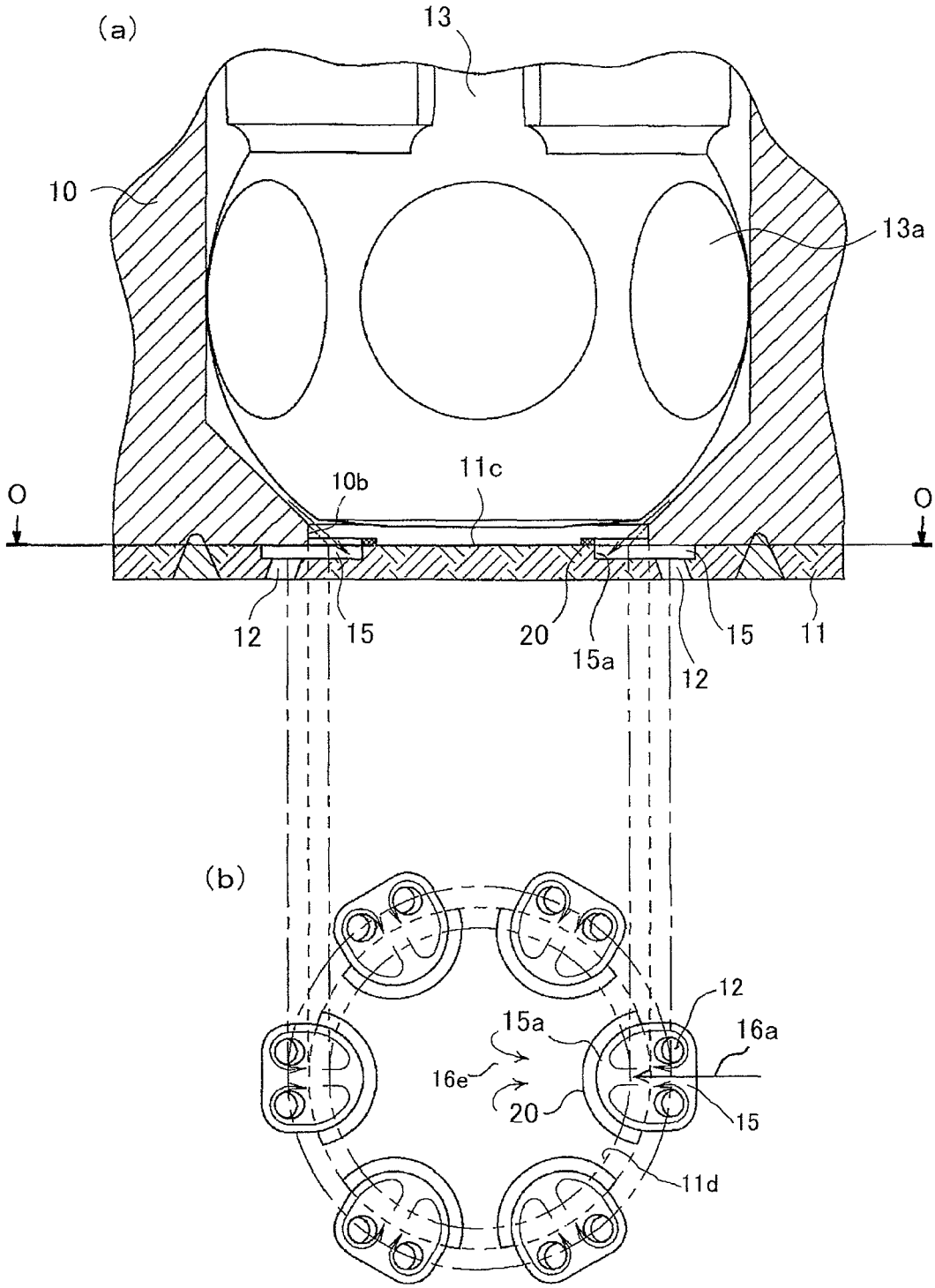
FIG. 13 is a set of cross-sectional view (a) and plan view (b) of the front end portion of a fuel injection valve according to Embodiment 13.

FIG. 13 illustrates the front end portion of a fuel injection valve according to Embodiment 13; FIG. 13(*a*) is a cross-sectional view of the valve-body front end portion; FIG. 13(*b*) is a plan view of the front end portion of a fuel injection valve in the case where the plane taken along the line O-O in FIG. 13(*a*) is viewed along the arrows. In Embodiment 13, as illustrated in FIG. 13, at a place, on an injection hole plate 11, which is further closer to the center of a virtual circle than a wall face 15*a*, of a fuel chamber 15, that is inside the virtual circle, there is provided a wall 20 protruding to the upstream side, in such a way as to follow the shape of the wall face 15*a* situated inside the inner circumference of the virtual circle. Accordingly, there can be suppressed a radial fuel flow 16*a* that flows from the center of the fuel injection valve to the fuel chamber 15. As a result, a swirling flow 16*a* is reinforced, whereby there can be expected an effect in which atomization is facilitated. The other configurations are the same as those of Embodiment 1; therefore, explanations therefor will be omitted.

Embodiment 14

Corresponding to Claim 19

Embodiment 14 is obtained by providing in FIG. 2 a flat portion 13*e* that protrudes from the valve seat portion 10*a* of the valve-body front end portion 13 toward the downstream side and is almost parallel to the injection hole plate 11. Accordingly, the volume (dead volume) surrounded by the valve body, the valve seat, and the injection hole plate while the valve is closed is reduced. As a result, there is reduced the amount of the fuel vaporized in the dead volume under a high-temperature and negative-pressure condition; therefore, variations, due to atmospheric change, in the flow rate characteristics (static flow rate/dynamic flow rate) and the fuel spray characteristics (fuel spray shape/fuel-spray particle diameter) can be suppressed.

Embodiment 15

Corresponding to Claim 20

Figure 14:
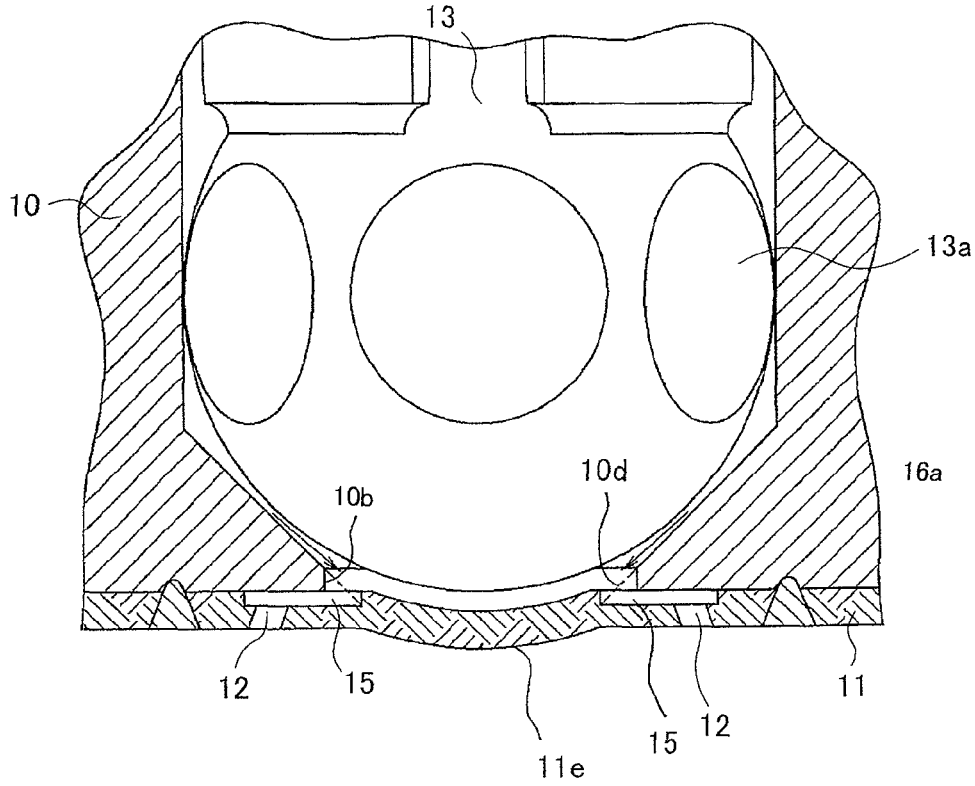
FIG. 14 is a cross-sectional view of the front end portion of a fuel injection valve according to Embodiment 15.

FIG. 14 is a cross-sectional view illustrating the front end portion of a fuel injection valve according to Embodiment 15. In Embodiment 15, as illustrated in FIG. 14, at the middle portion of an injection hole plate 11, there is formed a protrusion portion 11*e* that protrudes toward the downstream side in such a way as to be approximately parallel to the spherical shape of a valve-body front end portion 13 that protrudes from a valve seat portion 10*a*, and fuel chambers 15 are arranged in the vicinity of the protrusion portion 11*e*. Accordingly, the volume (dead volume) surrounded by the valve body, the valve seat, and the injection hole plate while the valve is closed is reduced.

As a result, there is reduced the amount of the fuel vaporized in the dead volume under a high-temperature and negative-pressure condition; therefore, variations, due to atmospheric change, in the flow rate characteristics (static flow rate/dynamic flow rate) and the fuel spray characteristics (fuel spray shape/fuel-spray particle diameter) can be suppressed. The other configurations are the same as those of Embodiment 1; therefore, explanations therefor will be omitted.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve in which a valve body for opening and closing a valve seat is provided, the fuel injection valve is configured to receive an operation signal from a control device so as to operate the valve body so that a fuel passes a gap between the valve body and a valve seat portion, the fuel injection valve comprising:

a plurality of injection holes provided in an injection hole plate mounted in a valve seat opening portion at the downstream side of the valve seat, the injection hole plate is disposed in such a way that an extended line along the plane of the valve seat portion of the valve seat whose diameter is gradually reduced in the downstream direction and an upstream plane of the injection hole plate intersect each other so that a virtual circle is formed; and a plurality of fuel chambers formed by recessing part of the upstream side of the injection hole plate at a plurality of positions along the valve seat opening portion, each of the fuel chambers having a shape, the halves of which are symmetric with each other with respect to a line that radially extends from the center of the injection hole plate, and the fuel chambers are disposed in a place that ranges from the inside of the virtual circle to the outside of the inner circumference of the valve seat opening portion, wherein in each of the fuel chambers, two injection holes are arranged outside the inner circumference of the valve seat opening portion in such a way as to flank the radial center line of the fuel chamber.

2. The fuel injection valve according to claim 1, wherein a wall face of each of the fuel chambers that is situated inside the virtual circle is in a shape of an arc, and halves of the wall face are symmetric with each other with respect to a line that radially extends from the center of the injection hole plate.

3. The fuel injection valve according to claim 1, wherein a wall face of each of the fuel chambers that is situated outside the inner circumference of the valve seat opening portion is in a shape of an arc that is concentric with the two injections holes.

4. The fuel injection valve according to claim 1, wherein inlets of the two injection holes provided in each of the fuel chambers are arranged in such a way as to be symmetric with each other with respect to the radial center line of the fuel chamber.

5. The fuel injection valve according to claim 1, wherein the front end of the valve body is in a shape of a sphere; in the sphere-shaped peripheral portion, there is formed a plurality of approximately semicircular planes; and there is formed a plurality of fuel paths in each of which another plane that intersects the semicircular plane is parallel to the center axis of the fuel injection valve.

6. The fuel injection valve according to claim 1, wherein a portion of each of the fuel chambers in the vicinity of each of the injection holes is shallower than other portions, the radial cross-sectional area of each of the fuel chambers is reduced in the vicinity of each of the injection holes.

7. The fuel injection valve according to claim 1, wherein a portion of each of the fuel chambers in the vicinity of each of the injection holes is narrower than other portions, the radial cross-sectional area of the fuel chamber is reduced in the vicinity of each of the injection holes.

8. The fuel injection valve according to claim 1, wherein the fuel chamber is integrated in the injection hole plate through coining.

9. The fuel injection valve according to claim 1, wherein an intermediate plate is provided between the valve seat and the injection hole plate; the plurality of fuel chambers is formed in the intermediate plate; the intermediate plate is fixed to the injection hole plate in such a way that each of the injection holes face one of the plurality of fuel chambers; the diameter of the intermediate plate is made smaller than that of the injection hole plate; and the intermediate plate is inserted into recesses formed by recessing the downstream side endface of the valve seat by the thickness of the intermediate plate.

10. The fuel injection valve according to claim 1, wherein at an inlet of each of the injection holes, there is formed a swirl chamber made of a cylindrical space whose diameter is larger than each of the injection hole inlets, in such a way as to be concentric with the injection hole inlets.

11. The fuel injection valve according to claim 1, wherein at an inlet of each of the injection holes there is formed a swirl chamber made of a space whose diameter is larger than each of the injection hole inlets and whose cross section is spherical in such a way as to be concentric with the injection hole inlets.

12. The fuel injection valve according to claim 1, wherein, when a tangential line is drawn at a point where the sidewall of the fuel chamber and the valve seat opening portion intersect each other, the distance between the tangential lines at a place where the fuel chamber is formed is larger than the distance between the tangential lines at a place where the fuel chamber is not formed.

13. The fuel injection valve according to claim 1, wherein an intermediate plate is provided between the valve seat and the injection hole plate; a nozzle hole communicating with the fuel chamber is formed in the intermediate plate; and the nozzle hole has a shape, the halves of which are symmetric with each other with respect to a radial line that extends from the center of the injection hole plate and whose area is smaller than the plane area of the fuel chamber.

14. The fuel injection valve according to claim 1, wherein at a place on the injection hole plate, which is further closer to the center of the virtual circle than a wall face of each of the fuel chambers that is inside the virtual circle, there is provided a wall protruding to the upstream side, in such a way as to follow the shape of the wall face situated inside the virtual circle.

15. The fuel injection valve according to claim 1, wherein, at the front end portion of the valve body, there is provided a flat portion that protrudes from the valve seat portion toward the downstream side and is approximately parallel to the injection hole plate.

* * * * *